US006035917A

United States Patent [19]

Cohen-Ravid

[11] Patent Number: 6,035,917

[45] **Date of Patent: *Mar. 14, 2000**

[54] FOLDABLE SECURITY BAR ASSEMBLY

[75] Inventor: Moshe Cohen-Ravid, Vancouver, Canada

[73] Assignee: Ravco Innovations, Inc., Vancouver, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/820,847

[22] Filed: Mar. 20, 1997

[51] Int. Cl.[7] ..... E04F 10/08

[52] U.S. Cl. ..... 160/35; 160/207

[58] Field of Search ..... 160/32, 33, 35, 160/36, 37, 84.01, 84.06, 84.02, 183, 405, 201, 207, 188

[56] References Cited

U.S. PATENT DOCUMENTS

| | | | |
|---|---|---|---|
| 343,956 | 6/1886 | Holmes . | |
| 813,631 | 2/1906 | Elmquist . | |
| 1,597,392 | 8/1926 | Rorabeck . | |
| 2,057,850 | 10/1936 | Sims | 186/60 |
| 2,095,690 | 10/1937 | Brunst | 189/56 |
| 2,423,987 | 7/1947 | Levikow | 160/35 |
| 2,672,192 | 3/1954 | Goldner | 160/32 |
| 2,882,045 | 4/1959 | Moore | 268/59 |
| 3,103,246 | 9/1963 | Brodsky | 160/188 |
| 3,289,350 | 12/1966 | Moody | 49/28 |
| 3,389,740 | 6/1968 | Buehler | 160/188 |
| 3,601,175 | 8/1971 | Wardlaw | 160/133 |
| 3,738,413 | 6/1973 | Frobosilo et al. | 160/35 |
| 3,739,832 | 6/1973 | Sivin | 160/133 |
| 3,842,891 | 10/1974 | Kinnroth et al. | 160/35 |
| 3,850,465 | 11/1974 | Hill et al. | 292/231 |
| 3,955,661 | 5/1976 | Popper et al. | 192/150 |
| 4,282,920 | 8/1981 | Kremm | 160/133 |
| 4,953,608 | 9/1990 | Larsson | 160/1 |
| 5,044,417 | 9/1991 | Bresson | 160/310 |
| 5,139,075 | 8/1992 | Desrochers | 160/310 |
| 5,373,887 | 12/1994 | Glover | 160/206 |
| 5,469,905 | 11/1995 | McKinney et al. | 160/35 |

FOREIGN PATENT DOCUMENTS

| | | |
|---|---|---|
| 0 756 062 A1 | 1/1997 | European Pat. Off. . |
| 866 843 | 2/1953 | Germany . |

*Primary Examiner*—David M. Purol
*Attorney, Agent, or Firm*—Fulbright & Jaworski L.L.P.

[57] ABSTRACT

A foldable security bar assembly, is convenient, aesthetic and less costly than existing security systems, and is used primarily for security rather than a shutter assembly. The assembly is for placing over or in an opening and has a plurality of horizontal bars extending between two channels, the two channels positioned one on each side of the opening with the bars slidable vertically within the channels. A plurality of connector links join adjacent bars together with at least one of the bars having a connection at each end within the channels to a raising and lowering mechanism in each channel coordinated to raise and lower the at least one bar and hence the whole assembly. A drive system is provided for the raising and lowering mechanism, and guides above or below the channels guide and retain the horizontal bars in a folded configuration above or below the opening with alternate bars on opposite sides.

35 Claims, 7 Drawing Sheets

FOLDABLE SECURITY BAR ASSEMBLY

TECHNICAL FIELD

The present invention relates to a foldable security bar assemblies for a window or door opening in a building.

BACKGROUND ART

There is a requirement for security bars to be used in front of windows and doors and particularly in front of store fronts and the like. Such security bars are needed to deter break-in attempts into a building. There are various types of security bars and shutters available some of the shutters are designed for weather protection such as hurricanes as well as security. Many of these shutters and security bars when raised up are rotated on a drum or alternatively fold into a large cage member positioned above the opening. One example of a hurricane shutter is that disclosed in U.S. Pat. No. 5,469,905. This patent shows a series of blades which accordion upwards into a cage or frame. The main purpose of the shutter is to provide strength against wind, but as a side effect the shutter provides security to prevent intruders from breaking in.

The hurricane shutter has heavy blades for weather protection. There is a requirement for a lighter security system for helping to prevent break-ins. The system has a plurality of spaced apart horizontal bars with connecting links. One example of such a system is that disclosed in U.S. Pat. No. 2,095,690 which shows a series of horizontal bars with connecting linkage members. The bars roll up on a drum. A similar system is shown in U.S. Pat. No. 3,739,832.

DISCLOSURE OF INVENTION

One aim of the present invention is to provide an improved retractable security bar assembly which is convenient, aesthetic and less costly than existing devices, one that is used primarily for security.

It is a further aim of the present invention to provide a security bar assembly having bars that move up and down in side channels and when either raised or lowered, the bars and connecting links fold into a folded configuration above or below the opening. The bars may be moved up and down manually or may be motorized and can lock in any position to prevent accidental lowering. In the case of a motorized arrangement, safety provisions stop movement of the bars if an object becomes caught in the opening. Thus the mechanism or the object is not damaged. It is a further aim to provide guides at the top of the opening or at the bottom of the opening which permits the security bars and the connecting links to fold in an accordion fashion into a space which is smaller than those presently available. The assembly has a frame comprising the two side channels. In one embodiment the frame also includes either a bottom plate which fits at the base of the opening or in the case of the folded configuration occurring below the opening, a top plate. In the case when the folded configuration of bars and connecting links is at the top, the lowest bar is locked adjacent the bottom plate when the security bars are closed to prevent forcing the security bars open.

It is a further aim to provide an emergency escape mechanism so that the security bar assembly can easily be removed from the inside of a building without having to raise or lower the security bars.

The present invention provides a foldable security bar assembly for an opening, comprising: a plurality of horizontal bars extending between two channels, the two channels positioned one on each side of the opening, the bars being slidable vertically within the channels and having ends of the bars retained in the channels; a plurality of connector links joining adjacent bars spaced apart along the bars, each of the connector links having at least one end pivotally connected to one of the horizontal bars; at least one bar of the plurality of horizontal bars having a connection at each end within each of the two channels to a raising and lowering mechanism in each channel coordinated to raise and lower the at least one bar and keep the at least one bar substantially horizontal; drive means for the raising and lowering mechanism, guide means adjacent the opening associated with the channels to guide the horizontal bars into a folded configuration with alternate bars on opposite sides, and retain the horizontal bars in the folded configuration.

In one embodiment the present invention provides a method of raising and folding a plurality of horizontal security bars from a top bar to a bottom bar joined by connector links, the bars extending between two channels on either side of an opening and slidable therein, comprising the steps of: raising the plurality of bars to push the top bar out of the channels above the opening; guiding the top bar to one side; raising the plurality of bars to push an adjacent bar to the top bar out of the channels above the opening; guiding the adjacent bar to the other side, and continuing raising the plurality of bars so further bars are guided to one side followed by the other side to form a folded configuration.

In another embodiment there is provided a method of lowering and folding a plurality of horizontal security bars from a top bar to a bottom bar, joined by connector links, the bars extending between two channels on either side of an opening and slidable therein comprising the steps of: lowering the plurality of bars so the bottom bar is out of the channels below the opening; guiding the bottom bar to one side; lowering the plurality of bars so an adjacent bar is out of the channels below the opening; guiding the adjacent bar to the other side, and continuing lowering the plurality of bars so further bars are guided to one side followed by the other side to form a folded configuration.

BRIEF DESCRIPTION OF DRAWINGS

In drawings which illustrate embodiments of the present invention.

BEST MODE FOR CARRYING OUT THE INVENTION

Figure 1:
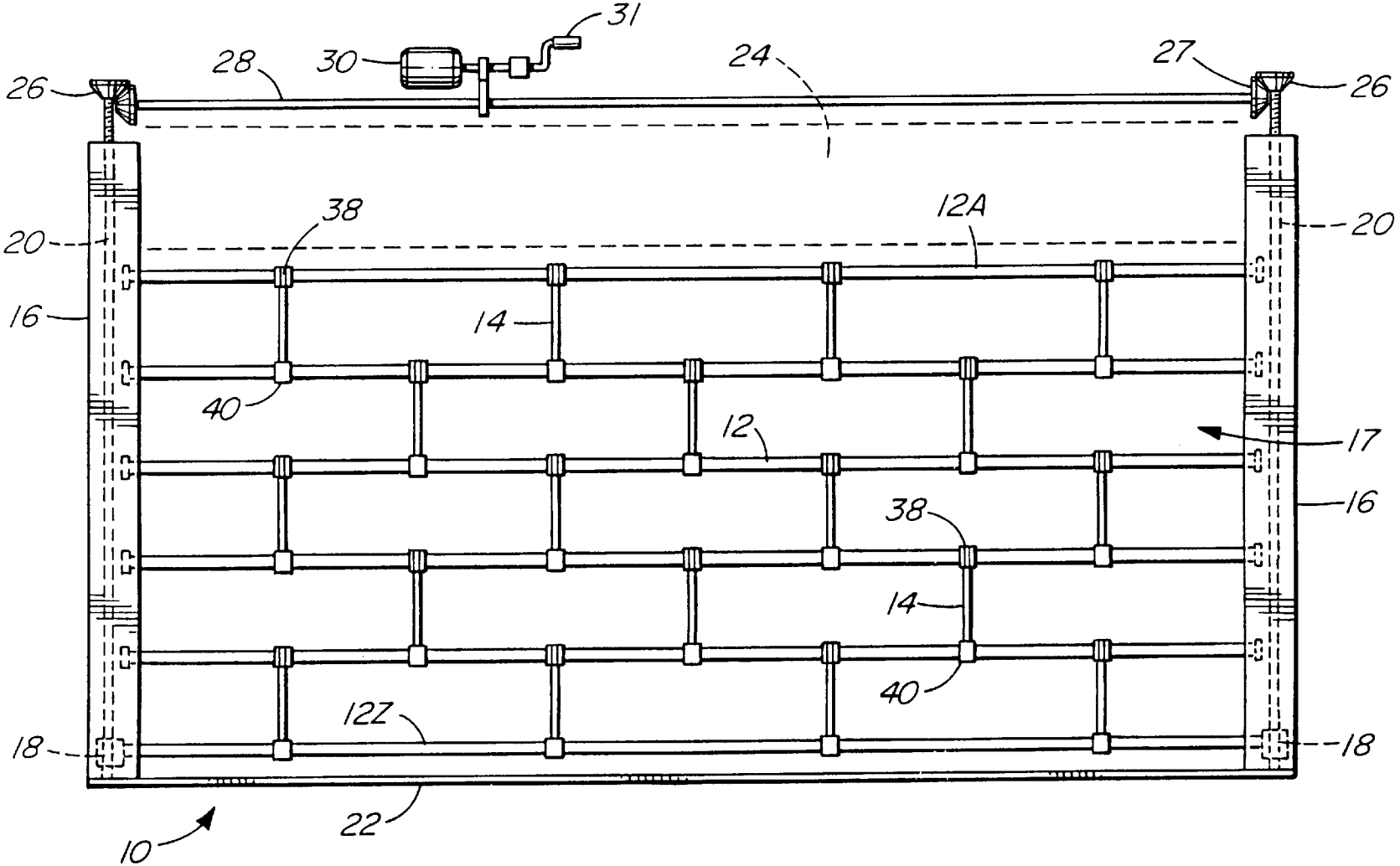
FIG. 1 is a front view showing a fold away security bar assembly in the secure position according to one embodiment of the present invention.

A fold away security bar assembly 10 is shown in FIG. 1 with a plurality of horizontal bars 12 spaced apart by connector links 14, which are interspaced between adjacent bars with connector links 14 for two adjacent bars 12 being interspaced between connector links 14 joined to bars above and below the two adjacent bars. Details of the connector links 14 will be described hereafter.

The ends of each bar 12 are inserted into channels 16 located vertically at the sides of an opening 17 which the security bar assembly 10 covers. The bottom horizontal bar 12Z has threaded attachments 18 at each end which in turn are connected to threaded shafts 20 in each channel 16.

The channels 16 are joined at the base to a bottom plate 22 extending below the opening 17. The bottom plate 22 as well as joining the channels 16 together may provide a bottom support for the bottom bar 12Z. In some applications, the bottom plate 22 is omitted and the lower edge of the opening forms the bottom support.

At the top of the two channels 16 is a space 24 to contain the bars 12 and connecting links 14 when in the raised folded configuration. First bevel gears 26 at the top of the threaded shafts 20 engage second bevel gears 27 on a connecting shaft 28 having a drive mechanism 30 containing a motor and gears for raising and lowering the assembly 10. The first bevel gears 26 are above the second bevel gears 27 so they can disengage when the threaded shafts 20 are raised as will be described hereafter.

Figure 2:
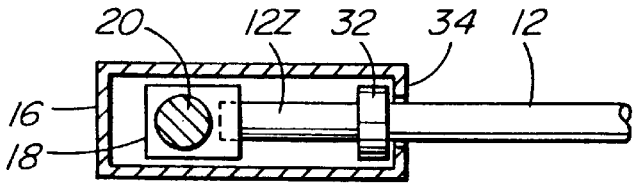
FIG. 2 is a partial sectional view showing a channel on one side of the security bar assembly of FIG. 1.
Figure 3:
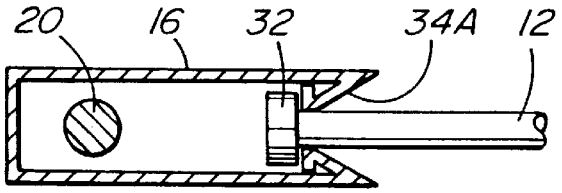
FIG. 3 is a partial sectional view showing another embodiment of a channel for the security bar assembly of FIG. 1.

FIG. 2 shows a retaining head 32 on the end of a horizontal bar 12 in the channel 16 which has lips 34 to prevent the bar 12 from being pulled out of the channel. The bottom bar 12Z of the assembly may not have retaining heads 32 as this is connected to threaded attachments 18 on the threaded shafts 20. FIG. 3 shows a channel 16 with inward sloping lips 34A. This configuration provides a stronger locking mechanism to retain the bars 12 in the channel 16. Any attempt to force the bars 12 to come out of the channel 16 results in the lips 34A being pushed inward to grip the bar 12 tightly.

Figure 4:
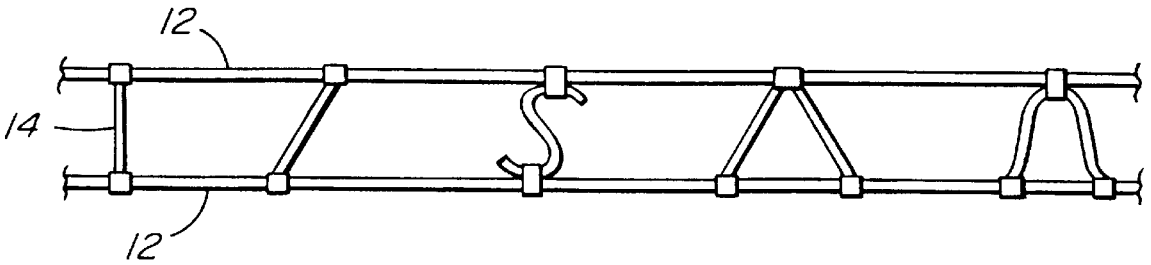
FIG. 4 is a partial elevational view showing different arrangements of connecting links for joining the horizontal bars together.

The connector links 14 as shown in FIG. 1 have a fixed attachment 38 at the top end wherein they are rigidly fixed to each bar 12 and a pivoted connection 40 at the bottom end connecting to an adjacent lower bar 12. FIG. 4 illustrates different shapes of connecting links 14 between bars 12. This view does not show the interspaced connector links 14 on the two adjacent bars 12.

Figure 5A:
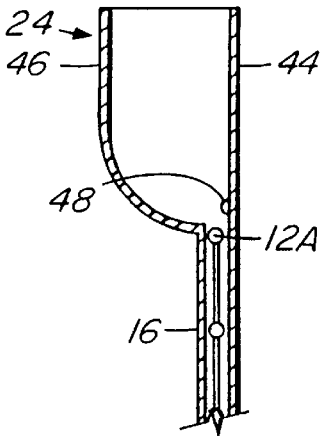
FIGS. 5A to 5F are sectional end views showing the security bar assembly with the bars and connecting links moving into a folded configuration above the opening.
Figure 5B:
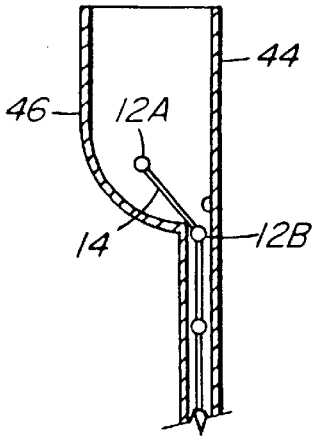
Figure 5C:
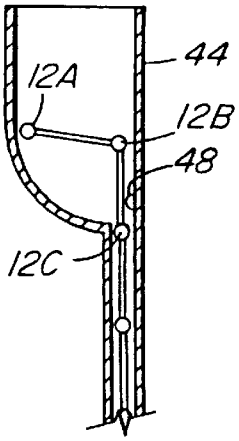
Figure 5D:
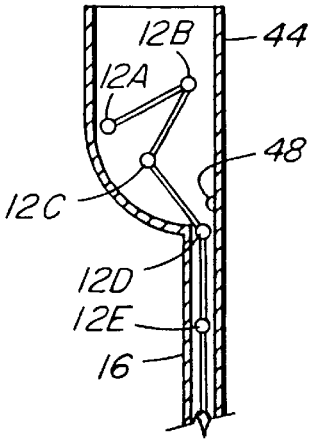
Figure 5E:
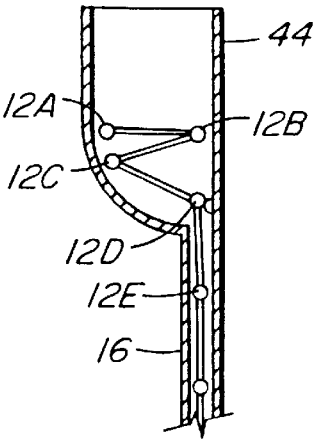
Figure 5F:
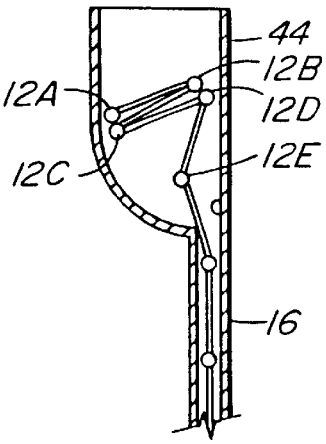

FIGS. 5A to 5F illustrate the bars 12 and connector links 16 folding into a space 24 above the opening. FIG. 5A illustrates the security bar assembly in the fully lowered position with the top bar 12A located at the top of the channel 16. The assembly is raised by rotating the threaded shafts 20 so that the nut attachments 18 rise upwards and the bottom bar 12Z, pushes the assembly of bars 12 and connector links 14 upwards. The arrangement shown in FIG. 5 is for the security bar assembly 10 to be mounted on a flat surface and therefore has a flat internal guide 44 and an outside curved guide 46 which extends up from the two sides of the channel 16. As the top bar 12A moves upwards as shown in FIG. 5B, it folds over towards the curved guide 46 of the space 24. A detent 48 is shown on the flat guide 44 just above the channel 16 to ensure that the top bar 12A does fold towards the curved guide 46. FIG. 5C shows the second bar 12B being pushed straight upwards to rest against the flat guide 44. FIG. 5D shows the third bar 12C being pushed over towards curved guide 46 and FIG. 5E shows the fourth bar 12D being pushed up against the flat guide 44. FIG. 5F shows the fifth bar 12E being pushed towards the curved guide 46. As the bottom bar 12Z forces the assembly upwards, alternate bars are directed to the curved guide 46 followed by the flat guide 44 to provide a folded configuration.

Figure 6:
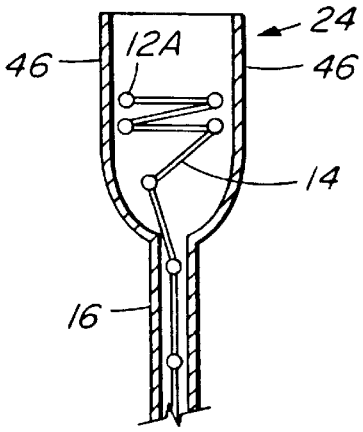
FIG. 6 is a sectional end view showing another embodiment of guides for retaining the security bars in a folded configuration above the opening.

FIG. 6 illustrates another embodiment of a space 24 for the folded configuration having two curved guides 46. This arrangement would not be suitable for mounting flush against a wall but may be built integrally into a building. The folded configuration will apply in the same manner as that shown in FIG. 5.

In another embodiment of the security bar assembly, as shown in FIGS. 7A to 7F, provision is made for the plurality of bars 12 and connector links 14 to be lowered into a folded configuration below the opening. At least one of the ends of connector links 14 have a pivoted connection to a bar 12, both ends may have pivoted connections.

Figure 7A:
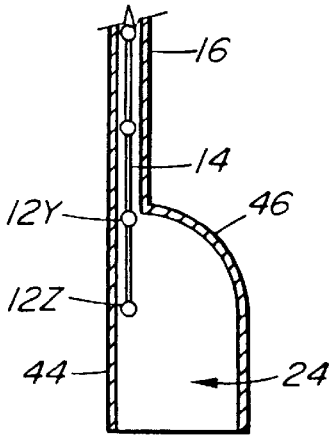
FIGS. 7A to 7F are sectional end views showing the security bar assembly with the bars and connecting links moving into a folded configuration below the opening.
Figure 7B:
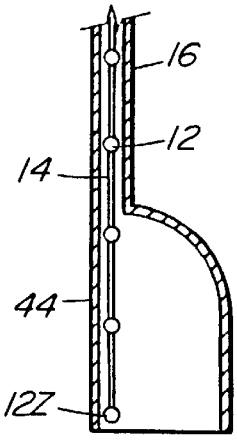
Figure 7C:
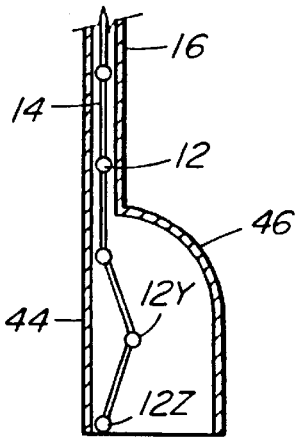
Figure 7D:
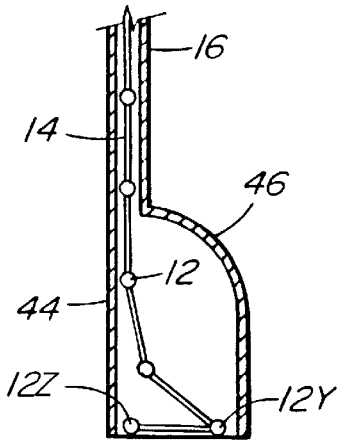
Figure 7E:
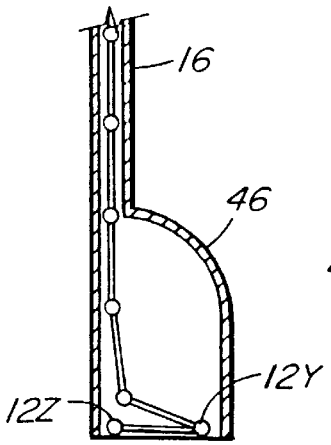
Figure 7F:
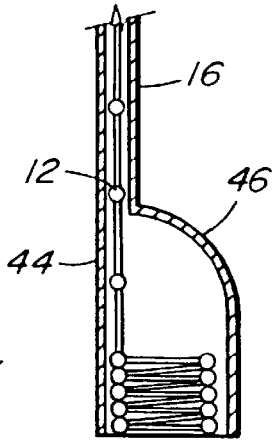

FIG. 7A illustrates the bottom bar 12Z entering the folding space 24, it reaches the bottom of the space 24 in FIG. 7B and in FIG. 7C the next bar 12Y commences to fold away from the flat guide 44 towards the curved guide 46. FIG. 7D shows the connector link 14 between the bars 12Z and 12Y flat on the bottom of the folding space. FIGS. 7E and 7F show the bars 12 and connector links forming into the folded configuration as the bars 12 are lowered.

Figure 8:
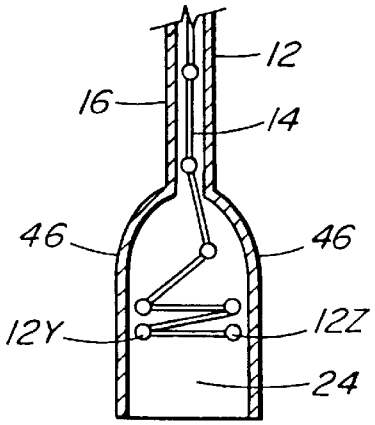
FIG. 8 is a sectional end view showing another embodiment of guides for retaining the security bars in the folded configuration below the opening.

FIG. 8 shows another embodiment of a folding space 24 below the opening with two curved guides 46 similar to the arrangement shown in FIG. 6 for a folded configuration above the opening.

Figure 9:
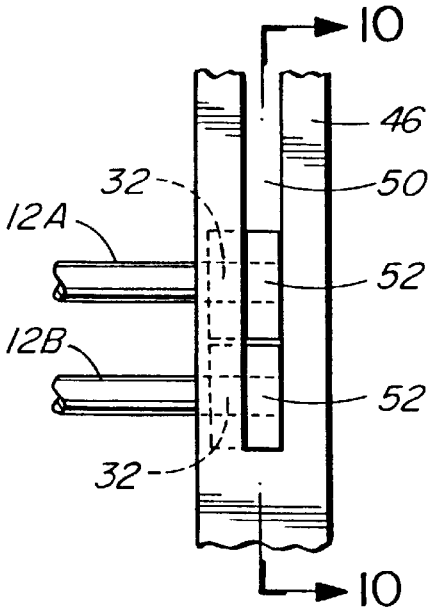
FIG. 9 is a partial front view showing one embodiment of guides with horizontal bars retained in the folded configuration.
Figure 10:
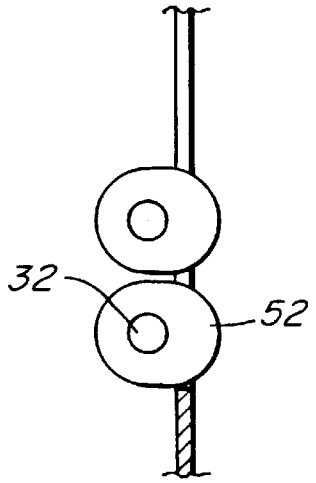
FIG. 10 is a partial sectional view taken at line 10—10 of FIG. 9 showing ends of bars with retaining ends in the guide slot of the guides.

FIGS. 9 and 10 illustrate the mechanism on the guides 44,46 to ensure that the bars 12 follow a folding configuration as illustrated in FIG. 5 and do not jam up when either the bar assembly 10 is raised or lowered in the channels 16. FIG. 9 illustrates a partial front view of the curved guide 46 having a vertical groove 50 along each of the channels 16. The retaining head 32 at the end of each bar 12 has an engagement portion 52 as illustrated in FIG. 10 at one side which engages in the groove 50 commencing on the curved guide 46 at the position where the top bar 12A contacts the curved guide 46 as shown in FIG. 5C. The groove 50 commences at the approximate position where the top bar 12A first touches the curved guide 46. The engagement portion 52 on the end of the retaining head 32 as shown in FIGS. 9 and 10 prevents the bars 12 from twisting away from a horizontal position and prevents jamming during the raising and lowering of the bars 12. Because the connector links 14 have a fixed end 38 attached to the bars 12, the engagement portion 52 is positioned opposite the projecting connector link 14 so that it is guided into the groove 50. When further bars 12 are raised and the connecting link 14 becomes substantially horizontal, the engagement portion 52 on the next retaining head 32 is guided into the groove 50. Thus the engagement portions 52 on both sides are guided into appropriate grooves 50 in the curved guide 46 and the flat guide 44. When unfolding, the engagement portion 52 on the lowest bar 12 pulls out of the groove 50 and the next bar 12 takes its place.

Figure 11:
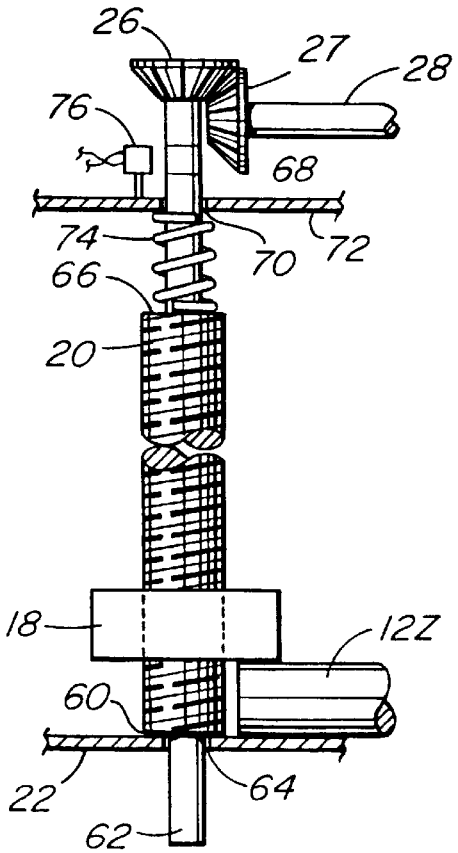
FIG. 11 is a sectional view through a channel showing a threaded shaft with the nut attachment thereon for raising the security bar assembly.
Figure 12:
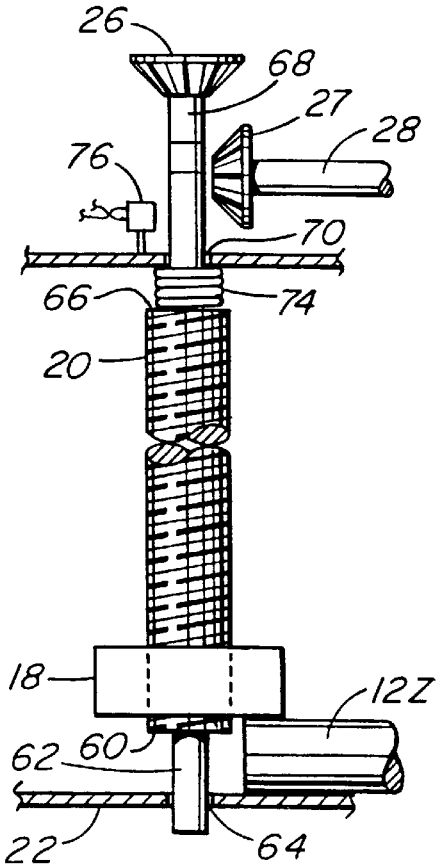
FIG. 12 is a sectional view through a channel similar to that shown in FIG. 11 with the threaded shaft raised to disengage the drive mechanism.

FIGS. 11 and 12 illustrate the threaded nut attachment 18 on the threaded shaft 20 attached to the bottom bar 12Z. As can be seen the bottom bar 12Z is attached to the underside of the nut 18 so that in the lowest position the bottom bar 12Z is flush with the bottom plate 22. The threaded shaft 20 has a bottom shoulder 60 with a smaller diameter lower portion 62 extending downwards through a hole 64 in the bottom plate 22. At the top of the threaded shaft 20 is top shoulder 66 which joins to an upper portion 68 having a smaller diameter that passes through a hole 70 in a plate 72 at the top of the channel 16. At the top of the upper portion 68 is a bevel gear 26 which meshes with a second bevel gear 27 on the connecting shaft 28. A spring 74 is positioned around the upper shaft portion 68 between the top shoulder 66 and the plate 72. When the bottom bar 12 reaches the bottom and rests against bottom plate 22 or hits an obstruction and cannot move further down, then at least one of the two threaded shafts 20 rises upwards as illustrated in FIG. 12 and this in turn disengages the bevel gears 26 and 27 so the shafts no longer rotate. A limit switch 76 is shown which cuts off the power to the motor when the threaded shafts 20 are raised and the bevel gears 26 and 27 disengage. Thus the mechanism prevents the bars being lowered if there is an obstruction in the opening or alternatively when the bottom bar 12Z reaches the bottom of the opening 17. Whereas this arrangement illustrates the bars being raised to a folded configuration above the opening, the same mechanism may be reversed and used when the folded configuration is below the opening.

Figure 13:
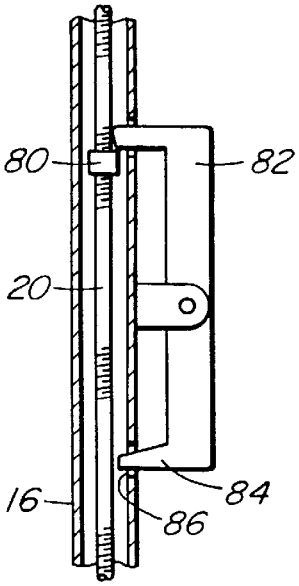
FIG. 13 is a partial front view showing a locking mechanism at the top of a channel to prevent the security bar assembly from being raised when in the lowered position.

Utilizing the mechanism shown in FIGS. 11 and 12 there is provided a collar 80 adjacent the top of the threaded shafts in the channel 16 below the guides 44 and 46 as shown in FIG. 13. When the lowest bar 12Z rests on the bottom plate 22, the threaded shaft 20 is raised upwards and the collar 80 pivots a lever arm 82 which has lower engagement end 84 that passes through an opening 86 in the channel 16. This engagement end 84 is positioned to stop an adjacent horizontal bar 12 from being raised. Thus the locking mechanism acts as a further security if for instance the bottom bar 12Z was broken or the connector links 14 severed then it would still not be possible to push the remaining bars 12 upwards because the engagement end 84 stops the next bar 12 from moving up, and the connector links 14 support the other bars 12 in their spaced relationship. This mechanism works in the same way when the folded configuration is below the opening.

Figure 14:
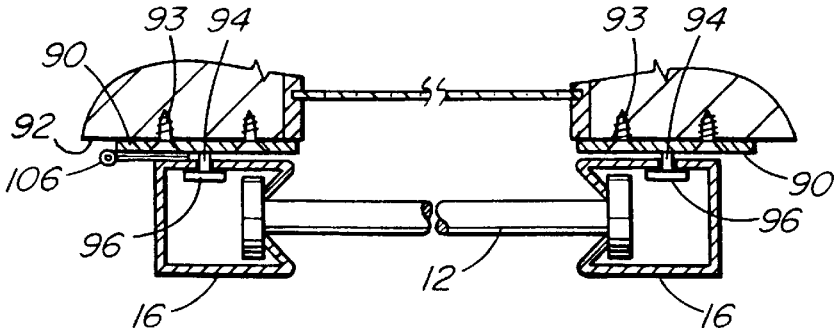
FIG. 14 is a top view showing the security bar assembly of FIG. 1 with quick release connections between the channels and the building wall.
Figure 15:
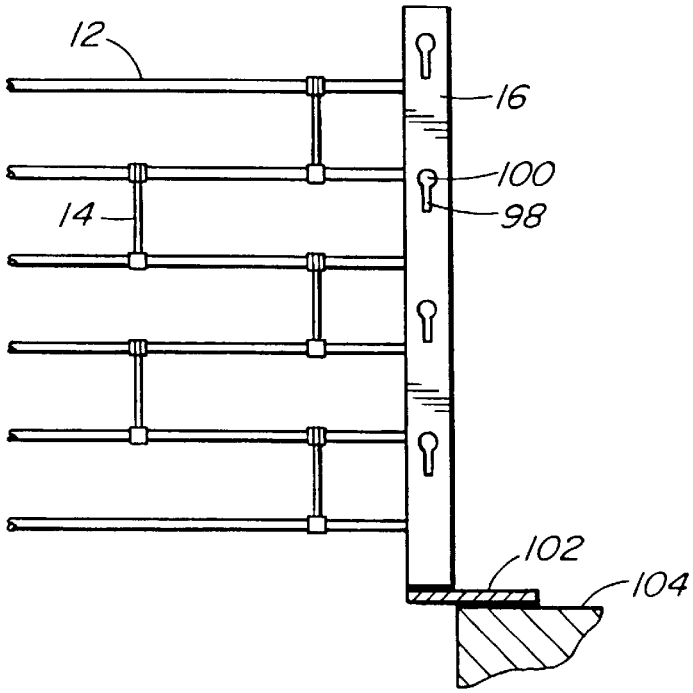
FIG. 15 is a partial elevational view of a mounting plate on the back of a channel showing elongated slots with wider top portions for engaging screws or bolts on the surface of a building, and showing the horizontal bars and connecting links.

In another configuration as shown in FIGS. 14 and 15, provision is made for quick release of the complete frame containing the security bar assembly from the side of a building. FIG. 14 illustrates mounting plates 90 attached to the wall surface 92 adjacent the opening. The plates 90 are located between the channels 16 and the wall surface 92 of a building. The mounting plate 90 is attached to the wall surface 92 by a number of wall screws 93 or other types of attachments and has a series of studs 94 which extend out with enlarged heads 96. As shown in FIG. 15, a series of elongated slots 98 with wider top portions 100 are provided in one side of the channels 16, and the slots 98 fit over the studs 94. A wedge 102 is positioned under each channel supported by a fixed member 104. The wedge holds the channels 16 at a height such that the enlarged heads 96 of the studs 94 are level with the slots 98 below the wider top portions. When the wedge is removed, and this is done by a quick release lever mechanism (not shown) the channels 16 drop down and the complete security bar assembly may be pushed clear of the wall surface with the enlarged heads 96 of the studs 94 passing through the wider top portions 100 of the slots 98. In another configuration, a hinge 106 is provided at one side of the assembly. The hinge 106 permits the assembly 10 to be swung open. This quick release mechanism for the security bar assembly 10 is for a fire escape or an emergency escape from a building particularly if there is power failure and one is not able to raise the bars 12.

In operation the bars 12 are kept in horizontal positions at all times. When there are in the folded configuration, it is essential that they retain their horizontal position to prevent tipping or falling to one side which causes the mechanism to jam. The engagement portion 52 on the retaining head 32 of each bar 12 aids in preventing tipping from occurring. When the bars are lowered, the bevel gears 26, 27 disengage, because the two threaded shafts 20 have lifted, and at the same time the locking mechanism as shown in FIG. 13 is engaged to lock one of the top bars 12. To raise the bars, the gears 26, 27 are reversed and as they engage each other, the threaded shafts 20 lower, so the collar 80 allows the lever arm 82 to pivot downwards disengaging the engagement end 84 from openings 86 in the channels 16 and the bars 12 move upwards into the cage 24 to form the folded configuration as illustrated in FIGS. 5A to 5F. The reverse operation occurs when the folded configuration is below the opening.

The rotation of the two threaded shafts 20 is shown in FIG. 1 by means of a connecting shaft 28 and bevel gears 26, 27 driven by a motor 30 or by a crank handle 31 for manual operation. In another embodiment there may be two synchronized motors each driving a threaded shaft 20. In a still further embodiment there may be a manual mechanism for rotating the threaded shafts 20, such a manual mechanism is synchronized so that both threaded shafts 20 rotate together to keep the bars substantially horizontal. The raising and lowering of the bar assembly is achieved by rotating the threaded shafts 20 when lowering the bottom bar 12Z lowers down to the bottom plate 22. When the bottom bar 12Z reaches the bottom, or if there is an obstruction preventing the bottom bar 12Z from moving down, then at least one of the threaded shafts 20 rises up disengaging the bevel gears 26, 27 and the motor 30 is turned off. When the threaded shafts 20 rise up, the top locking mechanism as shown in FIG. 12 is activated so that the upper bars 12 cannot be moved until after the locking mechanism is disengaged.

Whereas the movement of the bottom bar 12Z is illustrated as being by threaded nut attachments 18 on threaded shafts 20, it will be clear that other mechanisms may be provided such as a chain and sprocket mechanism or a cable and drum mechanism, in either case the two lifting mechanisms are synchronized so that the bars 12 remain horizontal when raising and lowering and in the folded configuration.

Figure 16:
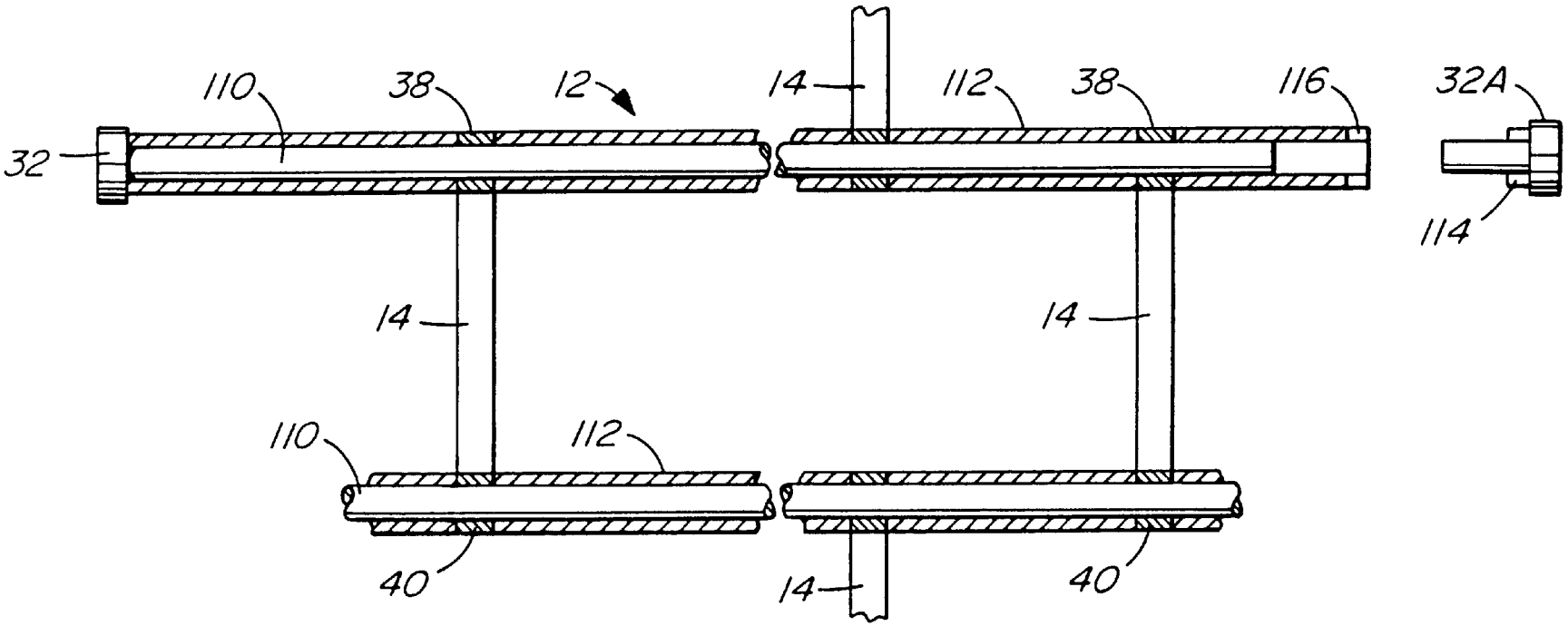
FIG. 16 is an exploded elevational view showing a modular constructed horizontal bars and connecting links.

The horizontal bars 12 themselves together with the connector links 14 may be made in modular units as shown in FIG. 16 with the bars 12 formed of internal rods 110 and sleeves 112 which are used to space connector links 14 apart. The rods 110 have a retaining head 32 at one end and a removable retaining head 32A at the other end with tongues 114 that engage with slots 116 in the adjacent sleeve 112. The connector links 14 are shown having one fixed connection 30 at one end of a bar 12 and having a pivoted connection 40 at the other end. In another embodiment the connector links 14 may have two pivoted ends. By having modular units of different sizes and lengths, security bar assemblies may be made up to cover any specific size opening and be foldable into a cage 24 positioned above the opening.

Various changes may be made to the embodiments shown herein without departing from the scope of the present invention which is limited only by the following claims.

I claim:

1. A foldable security bar assembly for an opening, comprising:

a plurality of horizontal bars extending between two channels, the two channels positioned one on each side of the opening, the bars being slidable vertically within the channels and having ends of the bars retained in the channels;

a plurality of connector links joining adjacent bars spaced apart along the bars, each of the connector links having at least one end pivotally connected to one of the horizontal bars;

at least one bar of the plurality of horizontal bars having a connection at each end within each of the two channels to a raising and lowering mechanism in each channel coordinated to raise and lower the at least one bar and keep the at least one bar substantially horizontal;

drive means for the raising and lowering mechanism, and guide means adjacent the opening associated with the channels to guide the horizontal bars into a folded configuration with alternate bars on opposite sides, and retain the horizontal bars in the folded configuration.

2. The security bar assembly according to claim 1 wherein the guide means is above the channels to guide into and retain the horizontal bars in the folded configuration above the opening.

3. The security bar assembly according to claim 1 wherein the guide means is below the channels to guide into and retain the horizontal bars in the folded configuration below the opening.

4. The security bar assembly according to claim 1 wherein the connector links for two adjacent bars are interspaced between connector links joined to bars above and below the two adjacent bars.

5. The security bar assembly according to claim 2 wherein a lower end of each of the connector links is pivotally connected to one of the bars and the top end of the connector link has a fixed connection to an adjacent bar.

6. The security bar assembly according to claim 2 wherein the raising and lowering mechanism comprises a threaded connection attached to each end of a bottom bar of the plurality of horizontal bars, the threaded connection engaging vertical threaded shafts in each of the channels.

7. The security bar assembly according to claim 3 wherein the raising and lowering mechanism comprises a threaded connection attached to each end of a top bar of the plurality of horizontal bars, the threaded connection engaging vertical threaded shafts in each of the channels.

8. The security bar assembly according to claim 6 wherein both the threaded shafts have bevel gears and including a connecting shaft extending horizontally between the bevel gears, the connecting shaft having mating bevel gears at each end and including a motor and drive mechanism to rotate the connecting shaft to raise and lower the security bar assembly with the bars remaining substantially horizontal.

9. The security bar assembly according to claim 6 wherein both the threaded shafts have bevel gears and including a connecting shaft extending horizontally between the bevel gears, the connecting shaft having mating bevel gears at each end and including a manual drive mechanism to rotate the connecting shaft to raise and lower the security bar assembly with the bars remaining substantially horizontal.

10. The security bar assembly according to claim 2 including a bottom plate at the base of the two channels which together with the guide means provides a frame for the security bar assembly.

11. A foldable security bar assembly for an opening, comprising:

a plurality of horizontal bars extending between two channels, the two channels positioned one on each side of the opening, the bars being slidable vertically within the channels and having ends of the bars retained in the channels;

a plurality of connector links joining adjacent bars spaced apart along the bars, the connector links joining the two adjacent bars being interspaced between connector links joining bars above and below the two adjacent bars, a top end of each of the connector links being fixed to one bar and the lower end of each of the connector links being pivoted to the adjacent bar such that the bars have fixed connections for the connector links to one adjacent bar and pivoted connections for the connector links to the other adjacent bar;

at least one bar of the plurality of horizontal bars having a threaded connection at each end engaged with a vertical threaded shaft in each of the two channels;

coordinated rotating mechanism with drive means to rotate the threaded shaft in each of the two channels to move the plurality of bars up and down; and guide means positioned above the opening associated with the channels to guide the horizontal bars into a folded configuration with alternate bars on opposite sides, and retain the horizontal bars in the folded configuration.

12. The security bar assembly according to claim 1 wherein the connector links are in a variety of different shapes.

13. The security bar assembly according to claim 11 wherein the ends of each of the bars have retaining heads to retain the ends of each of the bars in the two channels.

14. The security bar assembly according to claim 13 including an engaging portion extending from one side of each of the retaining heads opposite the connector link fixed to each bar, the engaging portion engaging in an elongated slot provided in the guide means above the channels to ensure each of the bars moves into the folded configuration when the bars are raised, and moves back into the channels when the bars are lowered.

15. The security bar assembly according to claim 13 wherein each of the two channels have lips tapered inwards to prevent the retaining heads being pulled out of the channels.

16. The security bar assembly according to claim 1 wherein the guide means associated with the channels comprises a first guide that extends in line from one side of each of the channels and rests against a wall surface and a second guide that curves away from the other side of each of the channels, the spacing between the first guide and the second guide permitting the bars and connector links to be retained in the folded configuration.

17. The security bar assembly according to claim 1 wherein the guide means associated with the channels comprises a first guide that curves away from one side of each of the channels and a second guide that curves away from the other side of each of the channels to provide a funnel shaped configuration, guiding and permitting the bars and connector links to be retained in the folded configuration.

18. The security bar assembly according to claim 1 wherein the combination of horizontal bars and connector links are constructed in modular units.

19. The security bar assembly according to claim 11 wherein the coordinated rotating mechanism to rotate the threaded shafts in each of the two channels comprises a horizontal connecting shaft with first bevel gears engaging second bevel gears located on the top of each of the threaded shafts together with drive means to rotate the connecting shaft so that the two threaded shafts rotate together to ensure the bars remain horizontal whilst moving up and down.

20. The security bar assembly according to claim 19 wherein the second bevel gears on the top of each of the threaded shafts are positioned above the first bevel gears on the horizontal connecting shaft, and each of the threaded shafts having provision to move upwards such that if an obstacle prevents the horizontal bars from being lowered then the threaded shafts move upwards to disengage the first bevel gears from the second bevel gears and thus prevent the threaded shafts from rotating.

21. The security bar assembly according to claim 20 including a spring means on top of each of the threaded shafts.

22. The security bar assembly according to claim 20 including a limit switch to turn off the motor when the threaded shafts move upwards disengaging the second bevel gears on the threaded shafts from the first bevel gears on the horizontal connecting shaft.

23. The security bar assembly according to claim 6 wherein each of the threaded shafts having provision to move upwards and including a locking mechanism positioned to lock one or more horizontal bars in the security bar assembly when the bottom bar reaches the bottom of the opening and the threaded shafts move upwards.

24. The security bar assembly according to claim 1 including a quick release mechanism to release the assembly and uncover the opening, the mechanism comprising a plurality of elongated slots with wider top apertures associated with at least one channel, the slots engaging attachment means from a wall surface on at least one side of the opening, and including a movable wedge member associated with the at least one channel for permitting the at least one channel to drop such that the security bar assembly may be disengaged from the wall surface with the attachment means passing through the wider top apertures of the elongated slots.

25. The security bar assembly according to claim 24 including at least one hinge at one side of the security bar assembly to permit the security bar assembly to swing open when the movable wedge member is removed to permit the security bar assembly to be lowered so that the attachment means pass through the wider top apertures of the elongated slots.

26. The security bar assembly according to claim 24 wherein the attachment means from the wall surface comprises plates on each side of the opening attached to the wall surface, the plates having studs with enlarged heads extending therefrom, the studs passing through the plurality of elongated slots in sides of the channels, and the enlarged heads of the studs passing through the wider top apertures of the elongated slots when the security bar assembly drops to disengage the security bar assembly from the wall surface.

27. A method of raising and folding a plurality of horizontal security bars from a top bar to a bottom bar, joined by connector links, wherein the connector links have top ends which are fixed to one of the horizontal bars and bottom ends which have pivoted connections to one of the adjacent horizontal bars, the bars extending between the two channels on either side of an opening and slidable therein, comprising the steps of:

raising the plurality of bars to push the top bar out of the channels above the opening;

guiding the top bar to one side;

raising the plurality of bars to push an adjacent bar to the top bar out of the channels above the opening;

guiding the adjacent bar to the other side; and continuing raising the plurality of bars so further bars are guided to one side followed by the other side to form a folded configuration.

28. A method of raising and folding a plurality of horizontal security bars from a top bar to a bottom bar, joined by connector links, the bars extending between two channels on either side of an opening and slidable therein, including a lowering safety mechnaism to stop lowering when the bottom bar hits an obstruction and/or reaches the bottom of lowering travel, comprising the steps of:

raising the plurality of bars to push the top bar out of the channels above the opening;

guiding the top bar to one side;

raising the plurality of bars to push an adjacent bar to the top bar out of the channels above the opening;

guiding the adjacent bar to the other side;

continuing raising the plurality of bars so further bars are guided to one side following by the other side to form a folded configuration.

29. The method of raising and folding a plurality of horizontal security bars according to claim 28 including a locking mechanism to prevent the horizontal bars from being raised when the bottom bar hits an obstruction and/or reaches the bottom of lowering travel.

30. A method of raising and folding a plurality of horizontal security bars from a top bar to a bottom bar, joined by connector links, the bars extending between two channels on either side of an opening and slidable therein, comprising the steps of:

raising the plurality of bars to push the top bar out of the channels above the opening;

guiding the top bar to one side;

raising the plurality of bars to push an adjacent bar to the top bar out of the channels above the opening;

guiding the adjacent bar to the other side;

continuing raising the plurality of bars so further bars are guided to one side followed by the other side to form a folded configuration; and quickly releasing the plurality of horizontal security bars by removing wedge members from beneath at least one of two channels on at least one side of the opening to permit the channel to disengage from attachment means attached to a wall surface adjacent the opening, thus allowing the plurality of bars and channels to be removed.

31. A method of lowering and folding a plurality of horizontal security bars from a top bar to a bottom bar, joined by connector links, the bars extending between two channels on either side of an opening and slidable therein, including a raising safety mechanism to stop raising when the top bar hits an obstruction and/or reaches the top of raising travel, comprising the steps of:

lowering the plurality of bars so the bottom bar is out of the channels below the opening;

guiding the bottom bar to one side;

lowering the plurality of bars so an adjacent bar is out of the channels below the opening;

guiding the adjacent bar to one side; and continuing lowering the plurality of bars so further bars are guided to one side followed by the other side to form a folded configuration.

32. The method of lowering and folding a plurality of horizontal security bars according to claim 31 including a locking mechanism to prevent the horizontal bars from being lowered when the top bar hits an obstructions and/or reaches the top of raising travel.

33. A method of lowering and folding a plurality of horizontal security bars from a top bar to a bottom bar, joined by connector links, the bars extending between two channels on either side of an opening and slidable therein, comprising the steps of:

lowering the plurality of bars so the bottom bar is out of the channels below the opening;

guiding the bottom bar to one side;

lowering the plurality of bars so an adjacent bar is out of the channels below the opening;

guiding the adjacent bar to the other side;

continuing lowering the plurality of bars so further bars are guided to one side followed by the other side to form a folded configuration; and quickly releasing the plurality of horizontal security bars by removing wedge members from beneath the two channels on either said of the opening to permit the channels to disengage from attachment means attached to a wall surface adjacent the opening, thus allowing the plurality of bars and channels to be removed.

34. The security bar assembly according to claim 1 wherein the ends of each of the bars have retaining heads to retain the ends of each of the bars in the two channels.

35. The security bar assembly according to claim 1 wherein each of the two channels have lips tapered inward to prevent the retaining heads being pulled out of the channels.

* * * * *

UNITED STATES PATENT AND TRADEMARK OFFICE

CERTIFICATE OF CORRECTION

PATENT NO. : 6,035,917
DATED : March 14, 2000
INVENTOR(S) : Moshe, Cohen-Ravid

It is certified that error appears in the above-identified patent and that said Letters Patent is hereby corrected as shown below:

In the specification

Column 1:
Line 5, delete "assemblies" and substitute --assembly--.
Line 50, delete "permits" and substitute --permit--.

Column 6:
Line 26, delete "there" and substitute --they--.
Line 52, delete "threaded shafts 20 when lowering the bottom" and substitute --threaded shafts 20. When lowering, the bottom--.

Column 7:
Line 9, delete "30" and substitute --38--.

Claim 28:
Line 32, delete "mechnaism" and substitute --mechanism--
Line 43, delete "following" and substitute --followed--

UNITED STATES PATENT AND TRADEMARK OFFICE

CERTIFICATE OF CORRECTION

PATENT NO. : 6,035,917
DATED : March 14, 2000
INVENTOR(S) : Moshe, Cohen-Ravid

It is certified that error appears in the above-identified patent and that said Letters Patent is hereby corrected as shown below:

Claim 31:
Line 18, delete "one" and substitute --the other--.

Claim 32:
Line 25, delete "obstructions" and substitute --obstruction--.

Signed and Sealed this

Nineteenth Day of June, 2001

*Attest:*

Nicholas P. Godici

*Attesting Officer*

NICHOLAS P. GODICI
*Acting Director of the United States Patent and Trademark Office*